US007651073B1

(12) United States Patent
Gibbs

(10) Patent No.: US 7,651,073 B1
(45) Date of Patent: Jan. 26, 2010

(54) FENCE POST

(76) Inventor: Edward L. Gibbs, 1555 N. Mingo Rd., Tulsa, OK (US) 74116

( * ) Notice: Subject to any disclaimer, the term of this patent is extended or adjusted under 35 U.S.C. 154(b) by 947 days.

(21) Appl. No.: 10/869,371

(22) Filed: Jun. 17, 2004

Related U.S. Application Data

(62) Division of application No. 10/306,125, filed on Nov. 27, 2002, now Pat. No. 6,874,767.

(60) Provisional application No. 60/370,372, filed on Apr. 5, 2002.

(51) Int. Cl.
*E04H 17/14* (2006.01)

(52) U.S. Cl. ..... 256/59; 256/65.02; 256/65.11; 256/65.14

(58) Field of Classification Search ..... 256/59, 256/1, 19, 65.02, 65.11, 65.14, 32, 34
See application file for complete search history.

(56) References Cited

U.S. PATENT DOCUMENTS

| | | | | |
|---|---|---|---|---|
| 338,343 | A | 5/1888 | Coker | |
| 426,558 | A | 4/1890 | Dithridge | |
| 991,603 | A | 5/1911 | Brooks | |
| 2,251,967 | A | 8/1941 | Yoder | |
| 2,337,626 | A | 12/1943 | Sawyer | |
| 2,907,552 | A | 10/1959 | Crone | |
| 3,305,221 | A | 2/1967 | Kling | |
| 3,307,833 | A | 3/1967 | Muller et al. | |
| 3,342,007 | A | 9/1967 | Merson | |
| 3,397,866 | A | 8/1968 | Hockett | |
| 3,698,224 | A | 10/1972 | Saytes | |
| 3,869,109 | A * | 3/1975 | Russo | 256/59 |
| 3,879,017 | A * | 4/1975 | Maxcy et al. | 256/65.08 |
| 3,902,703 | A | 9/1975 | Bouye | |
| 4,007,919 | A * | 2/1977 | Totten | 256/59 |
| 4,047,355 | A | 9/1977 | Knorr | |
| 4,075,473 | A | 2/1978 | Winston | 256/13.1 |

(Continued)

FOREIGN PATENT DOCUMENTS

| | | |
|---|---|---|
| EP | 172075 A1 | 2/1986 |

(Continued)

OTHER PUBLICATIONS

British Standards Institute, BS 1722, Part 12, Specification for Steel Palisade Fences, published 1999, United Kingdom, all pages.

(Continued)

*Primary Examiner*—Nitin C Patel
(74) *Attorney, Agent, or Firm*—Gary Peterson

(57) ABSTRACT

A high security palisade fence is formed from a plurality of vertical posts, each of which is characterized by a pair of flange sections which are joined by an intermediate flat web section having a double-walled structure. One or more cable passageways are formed in each post. Each adjacent pair of posts is interconnected by a plurality of parallel rails. Each rail is formed with an internal tray, within which a strengthening cable may extend. Vertical pickets are attached to the rails. The pickets are preferably characterized by a W-shaped profile, and preferably include longitudinal strengthening ribs. Each picket has a flat attachment surface in which a plurality of subsurface recesses are formed.

65 Claims, 7 Drawing Sheets

U.S. PATENT DOCUMENTS

| | | | | | |
|---|---|---|---|---|---|
| 4,246,737 | A | | 1/1981 | Eiloart et al. | |
| 4,455,806 | A | | 6/1984 | Rice | |
| 4,819,916 | A | | 4/1989 | Wun-chung | 256/13.1 |
| 4,858,383 | A | | 8/1989 | Kendig | |
| 4,964,618 | A | * | 10/1990 | Kennedy et al. | 256/24 |
| 4,979,817 | A | | 12/1990 | Crisp, Sr. | 256/13.1 |
| 5,136,813 | A | | 8/1992 | Gibbs et al. | |
| 5,272,838 | A | | 12/1993 | Gibbs | |
| 5,275,382 | A | * | 1/1994 | Charbaut et al. | 256/48 |
| 5,345,723 | A | | 9/1994 | Gibbs | 49/506 |
| 5,443,244 | A | | 8/1995 | Gibbs | |
| 5,702,090 | A | * | 12/1997 | Edgman | 256/19 |
| 5,860,636 | A | | 1/1999 | Duncan et al. | |
| 6,042,301 | A | * | 3/2000 | Sovran | 405/112 |
| 6,065,738 | A | | 5/2000 | Pearce et al. | 256/13.1 |
| 6,141,926 | A | * | 11/2000 | Rossiter et al. | 52/239 |
| 6,176,043 | B1 | | 1/2001 | Gibbs | |
| 6,190,085 | B1 | | 2/2001 | Johansson | 256/13.1 |
| 6,226,849 | B1 | * | 5/2001 | Beck et al. | 29/407.05 |
| 6,254,064 | B1 | | 7/2001 | Gibbs | |
| D465,856 | S | | 11/2002 | Givens et al. | D25/122 |
| D466,620 | S | | 12/2002 | Givens et al. | D25/122 |
| D467,669 | S | | 12/2002 | Givens et al. | D25/121 |
| D468,028 | S | | 12/2002 | Givens et al. | D25/121 |
| 6,545,246 | B2 | | 4/2003 | Kummle | |
| 6,811,144 | B2 | | 11/2004 | Denman et al. | 256/13.1 |
| 6,848,230 | B2 | * | 2/2005 | Kopish | 52/656.9 |
| 6,874,765 | B2 | | 4/2005 | Deeley | 256/21 |
| 2003/0164487 | A1 | | 9/2003 | Deeley | 256/65.01 |
| 2003/0193047 | A1 | | 10/2003 | Wiley | 256/59 |
| 2003/0197163 | A1 | | 10/2003 | Deeley | 256/22 |
| 2005/0116212 | A1 | | 6/2005 | Deeley | 256/22 |

FOREIGN PATENT DOCUMENTS

| | | | |
|---|---|---|---|
| EP | 282269 | B1 | 1/1991 |
| EP | 443441 | B1 | 3/1994 |
| EP | 935038 | A1 | 8/1999 |
| EP | 949395 | A2 | 10/1999 |
| FR | 704320 | | 5/1931 |
| FR | 1539118 | | 9/1968 |
| FR | 2372296 | A1 | 6/1978 |
| FR | 2722820 | A1 | 1/1996 |
| GB | 1232494 | | 5/1971 |
| GB | 1551154 | | 8/1979 |
| GB | 2249327 | A | 5/1992 |
| GB | 2350846 | A | 12/2000 |
| GB | 2363400 | A | 12/2001 |
| GB | 2372758 | A | 9/2002 |
| GB | 2372759 | A | 9/2002 |
| WO | WO-95/33113 | | 12/1995 |
| WO | WO 97/03266 | A1 | 1/1997 |
| WO | WO-02/070838 | A1 | 9/2002 |

OTHER PUBLICATIONS

Catalog, Ameristar Fence Products, Inc., "Aegis Ornamental Steel Residential Fencing," all pages, published in the United States no later than Apr. 2001.

Catalog, Ameristar Fence Products. Inc., "Aegis II Industrial Aegis Plus Commercial Ornamental Steel Fence and TransPort namental Gates," all pages, published in the United States in Aug. 2000.

* cited by examiner

FENCE POST

CROSS-REFERENCE TO RELATED APPLICATIONS

This application is a division of U.S. patent application Ser. No. 10/306,125, filed Nov. 27, 2002, now U.S. Pat. No. 6,874,767, which claims the benefit of the filing date of provisional U.S. Patent Application Ser. No. 60/370,372, filed Apr. 5, 2002. These applications are incorporated by reference in their entirety.

FIELD OF THE INVENTION

The present invention relates generally to fences and fence components, and more particularly to high security palisade fences, and components suitable for use in such fences.

SUMMARY OF THE INVENTION

The present invention comprises a post having a first flange section, a flange section, and a flat web section disposed between the first and second flange sections. The web section is formed from two abutting planar sections which define a double-walled structure.

The present invention further comprises a rail having two lateral edge portions, comprising, an upper section which includes one of the edge portions, and a lower section which includes the other edge portion. The lower section comprises a flat side wall providing an attachment surface, a first lip disposed in spaced and parallel relationship to the side wall, and a base which connects the first lip and the side wall. The side wall, first lip and base cooperate to define a tray within which a strengthening cable may extend.

In another aspect, the present invention comprises a rail formed having two lateral edge portions, comprising a lower section which includes one of the edge portions, and an upper section including the other edge portion. The lower section comprises a flat side wall providing an attachment surface, while the upper section comprises a lip which extends toward the plane of the side wall.

The present invention further comprises a picket comprising a first channel having two sides. The picket further comprises a second channel situated on one side of the first channel, in an inverted relationship thereto, and a third channel situated on the other side of the first channel, also in an inverted relationship thereto. Each channel is defined by a pair of spaced side walls, and a longitudinal rib having a sharply angled profile is formed in at least one of the side walls defining at least one of the channels.

The present invention further comprises a picket which is adapted for attachment to a support by a plurality of fasteners, each fastener having a head and a shank. The picket comprises a substantially flat attachment surface, in which a plurality of spaced subsurface recesses are formed. Each such recess includes a base in which a fastener opening is formed, and is sized to receive the fastener head with minimal peripheral clearance, when the fastener shank is extended through the fastener opening.

BRIEF DESCRIPTION OF THE DRAWINGS

FIG. 8 is a cross-sectional view of the fence rail of the presence invention. A strengthening cable is shown in an installed position within the internal tray of the rail.

FIG. 9 is a perspective view of a portion of the fence rail of the present invention.

DETAILED DESCRIPTION

Figure 1:
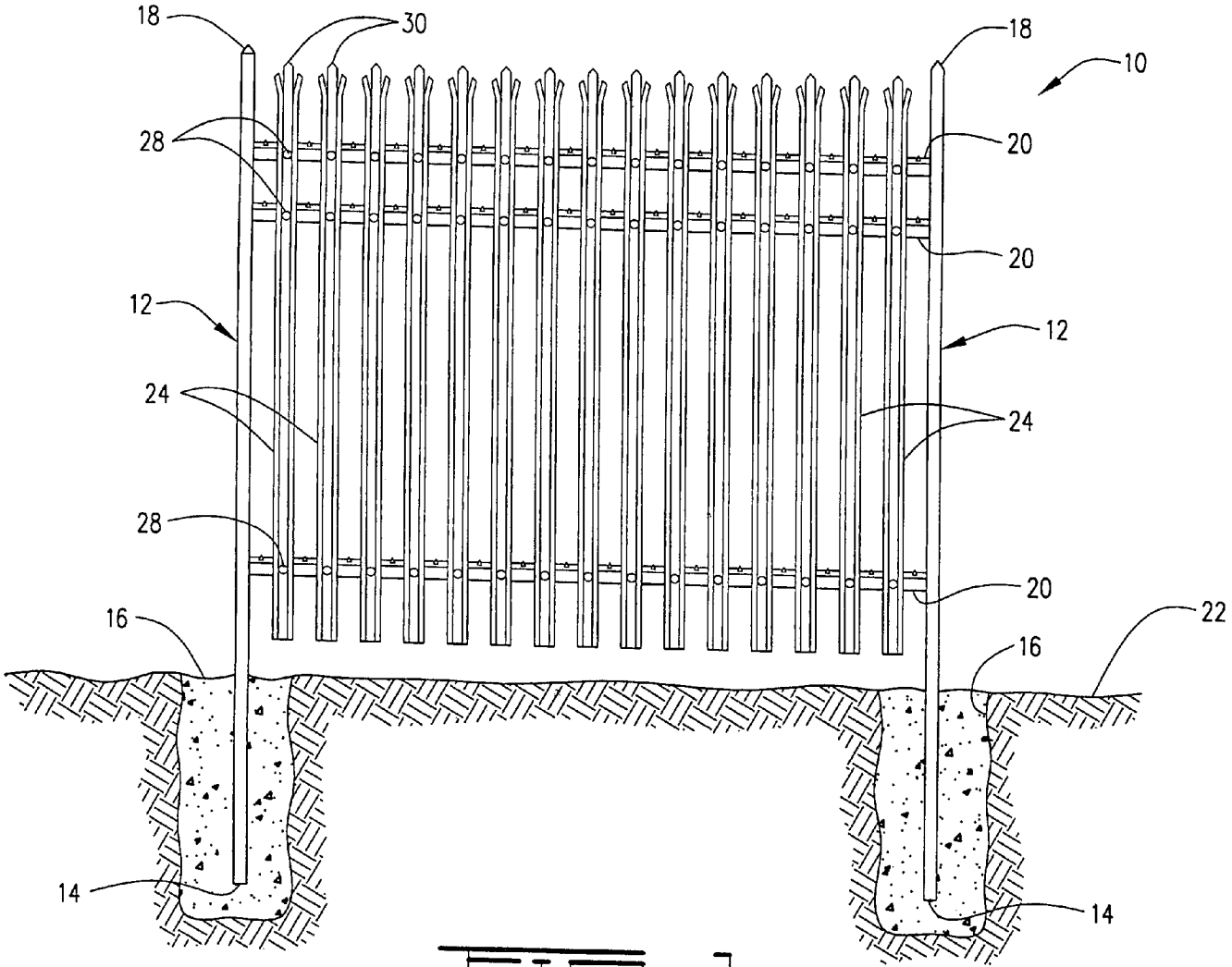
FIG. 1 is a front elevational view of a section of the fence of the present invention, showing the fence rails, fence pickets, and fence posts. The terrain and substrate supporting the fence are shown in cross section.

With reference to FIG. 1, the present invention comprises a high security palisade fence 10, generally designated by reference numeral 10. The fence comprises a plurality of spaced vertical posts 12, preferably identical in construction, each of which is securely anchored at its base 14 into a substrate 16, such as an underground mass of concrete. The posts 12 are situated along the boundary of the area to be enclosed by the fence 10, with a post spacing which is adequate to impart strength to the fence 10 and to securely anchor other fence components. In one preferred embodiment, adjacent posts 12 are separated by a distance no greater than 8 feet.

Figure 2:
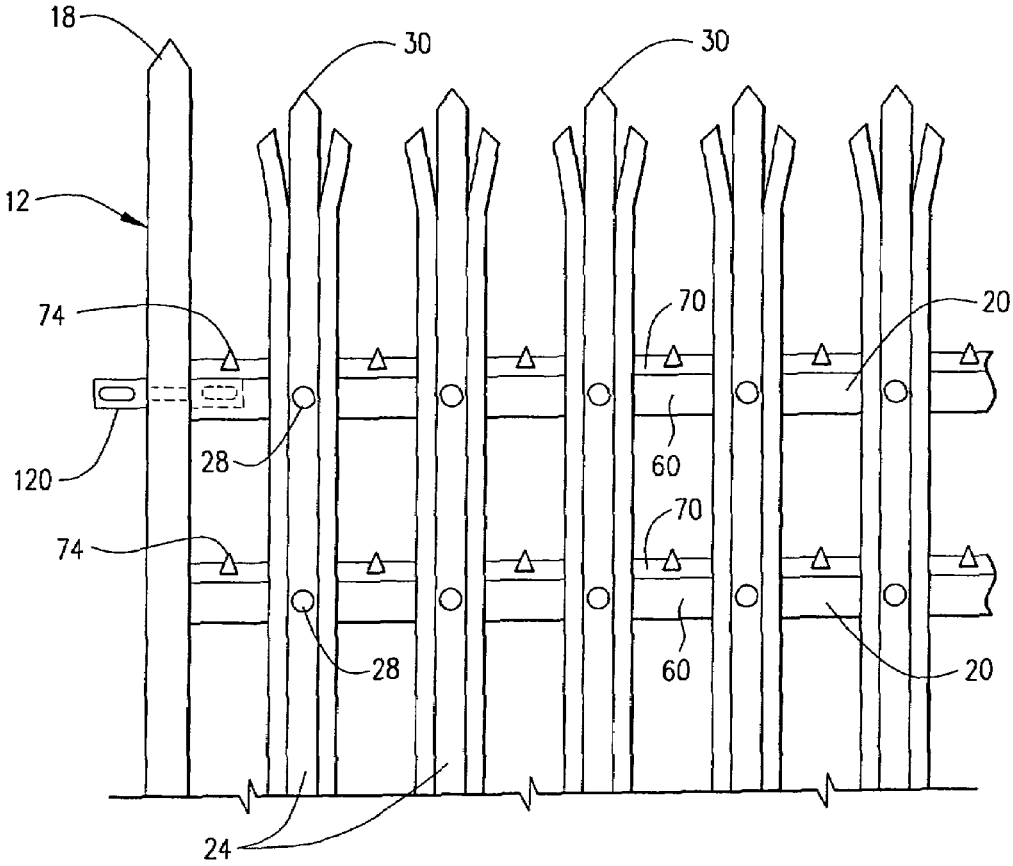
FIG. 2 is an enlarged and detailed front elevational view of a portion of the fence shown in FIG. 1.

The above-ground height of each post 12, in its installed configuration, is preferably substantially in excess of the height of a human or other intruder. In one preferred embodiment, the above-ground height of each post is at least 8 feet. The upper end 18 of each post 12 is preferably formed into a pointed or sharpened configuration which will deter and hinder climbing, such as a spear or spike, as best shown in FIG. 2. Alternately, posts having round or flat tops may be used.

With continued reference to FIGS. 1 and 2, the fence 10 further comprises a plurality of elongate rails 20, preferably of identical construction. Each of the rails 20 extends between an adjacent pair of posts 12, and as is supported by the posts 12 at its opposite ends. At least two, and preferably three or more rails 20 extend between each adjacent pair of posts. The length of each rail 20 should be sufficient to fully span the distance between the adjacent of pair of posts 12 which will support that rail 20.

The rails 20 which extend between a given pair of posts 12 are preferably disposed in parallel relationship. The incline of each rail 20 with respect to horizontal should substantially equal the incline of the terrain 22 on which pair of posts 12 supporting that rail 20 are installed. Thus, when the fence 10 is positioned on horizontal terrain, as shown in FIG. 1, the rails 20 will be disposed substantially horizontally.

With continued reference to FIGS. 1 and 2, the fence 10 further comprises a plurality of vertically disposed pickets 24, preferably of identical construction. A plurality of fasteners 28 are used to secure each picket 24 to each of the rails 20, with the base 26 of each picket 24 preferably situated no more than a small distance above the terrain 22 supporting the fence 10, in order to prevent an intruder from traversing the gap between the base of the picket 24 and the terrain 22.

The vertical height of each picket 24 is preferably approximately equal to the vertical height of the posts 12. The pickets 24 are preferably oriented in parallel relationship, with a separation distance between adjacent pickets 24, and between each post 12 and its adjacent picket 24, which is sufficiently small to prevent an intruder from traversing the gap. In one preferred embodiment, the separation distance between the centers of adjacent pickets 24, and between each post 12 and its adjacent picket 24, is no more than 6 inches. Between adjacent pairs of posts 12, pickets 24 should be provided in sufficient number to assure that the separation distance adjacent pickets 24, or between a post 12 and an adjacent picket 24, does not exceed the requisite distance. In the embodiment shown in FIG. 1, for example, 15 pickets are installed, with a center-to-center separation of 6 inches, in the 8-foot distance between adjacent posts 12.

The upper end 30 of each picket 24 is preferably formed into a pointed or sharpened configuration which will deter and hinder climbing, such as a spear or spike. In the embodiment shown in FIGS. 1 and 2, the upper end 30 of each picket 24 has been formed in a splayed configuration providing a plurality of spear-like protrusions. Alternately, pickets having round or flat tops may be used.

Figure 3:
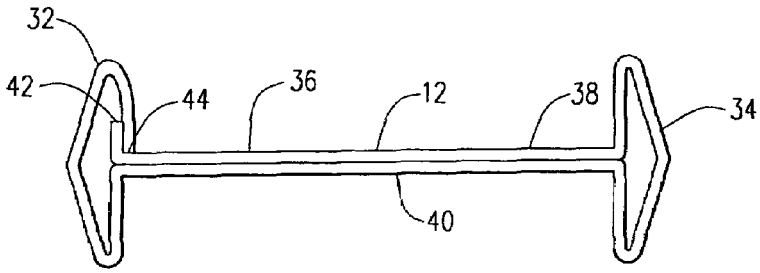
FIG. 3 is a top plan view of a fence post of the present invention.

With reference to FIG. 3, each post 12 is preferably formed from a strong and durable material, such as a strip of sheet steel. In a preferred embodiment of the present invention, the steel is characterized by a thickness of 0.1 inches. In order to enhance its resistance to corrosion, this steel is preferably subjected to a pre-galvanizing treatment. The pre-galvanized steel is then subjected to a cold rolling process to produce the cross-sectional shape shown in FIG. 3. After cold rolling is complete, a polyester powder coating is preferably provided in order to further enhance corrosion resistance of the post 12.

Figure 4:
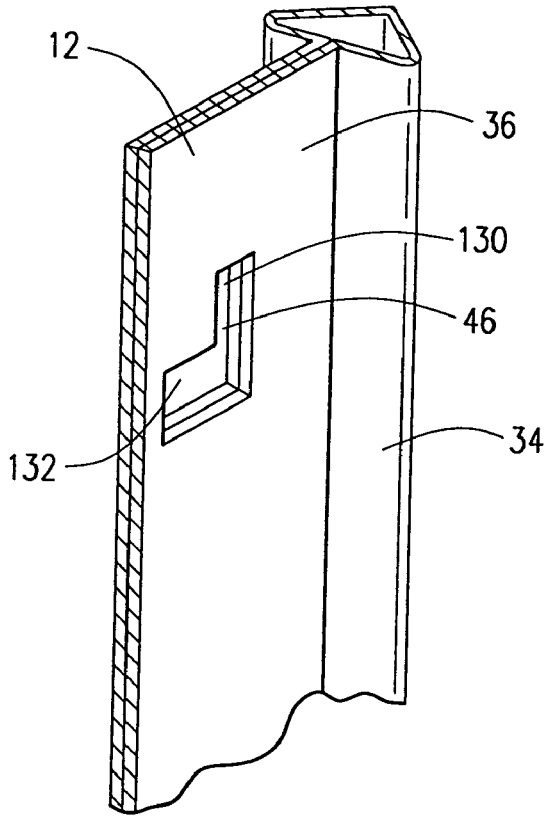
FIG. 4 is perspective view of the upper portion of the fence post of the present invention. One of the flanges has been removed in order to permit better display of other components.

As shown in FIGS. 3 and 4, the post 12 is characterized a pair of opposed flange sections 32 and 34, which are joined by flat web section 36. The opposite lateral edge portions 42 and 44 of the sheet steel used to form the post 12 are preferably folded into an overlapping and abutting configuration. This overlapping configuration improves resistance to corrosion and enhances the strength of the post 12.

The flange sections 32 and 34 are each characterized by a triangular cross-section, with the triangular bends serving to strengthen of the flange sections 32 and 34 against lateral loading. The flat web section is 36 a double-walled structure formed from abutting planar sections 38 and 40. In the preferred embodiment shown in FIG. 3, the web section 36 is 4 inches in width, while the flange sections 32 and 34 are each 1.75 inches in length.

As shown in FIG. 4, a plurality of apertures 46 are formed in the web section 36 of the post 12, preferably by stamping. Preferably, the apertures 46 are placed in the steel sheet used to form the post 12 before the sheet undergoes cold rolling to form the post 12. The number of apertures 46 formed in the web section 36 should equal the number of rails 20 supported by the post 12, with the vertical position of each aperture 46 matching that of a corresponding rail 20 in a one-to-one relationship.

Figure 5:
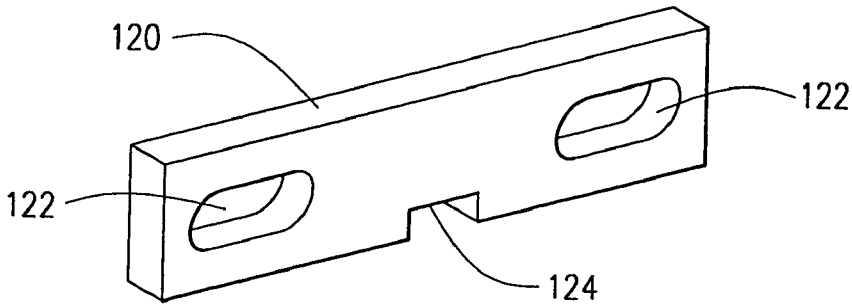
FIG. 5 is a perspective view of the fish plate of the present invention.
Figure 6:
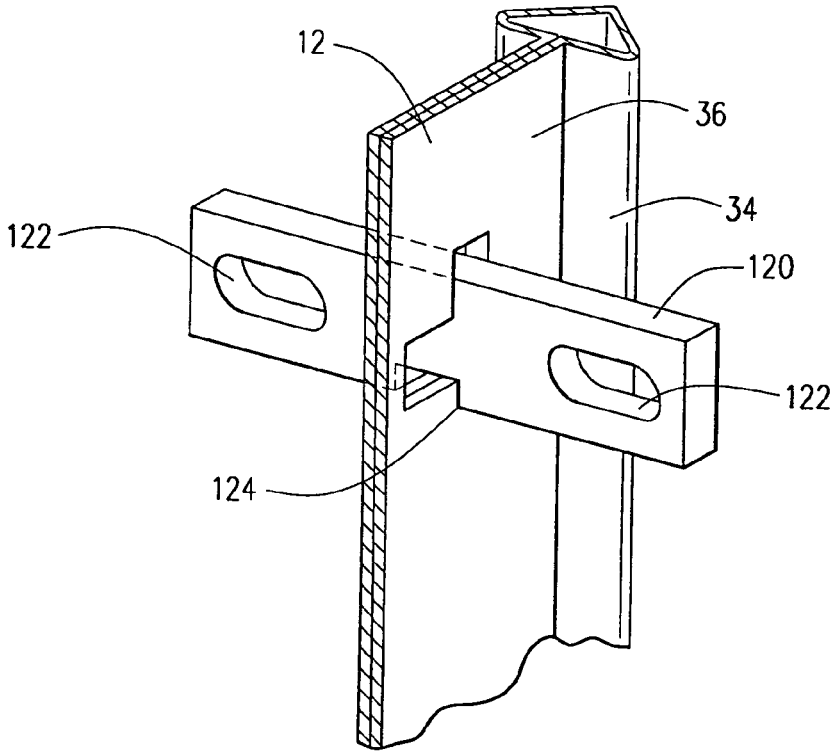
FIG. 6 is a perspective view fish plate and a portion of the fence post of the present invention, in their assembled configuration. One of the flanges has been remove in order to permit better display of other components.

With reference to FIGS. 4, 5 and 6, each aperture 46 is preferably characterized by an "L" shape which includes a vertical arm 130 and a horizontal arm 132. The vertical arm 130 of each aperture 46 is sized to receive, with minimal cross-sectional clearance, the upper portion of an elongate fish plate 120. The fish plate 120 is penetrated on its sides by elongate fastener openings 122 formed in opposite ends thereof, and is further characterized by a lock notch 124 formed in a medial portion of its base. As shown in FIG. 6, the fish plate 120 is inserted into the vertical arm 130 of the aperture 46 so that the lock notch 124 is aligned with the web 36. In this installed configuration, lateral movement of the fish plate 120 is possible, but is limited by the lock notch 124.

The horizontal arm 132 of each aperture 46 will remain clear even after installation of fish plate 120 into the aperture 46. The horizontal arm 132 of each aperture 46 is preferably sized to clearingly receive a strengthening cable, so that it may function as a cable passageway. The construction and arrangement of the strengthening cable of the present invention will be described in greater detail hereafter.

In an alternate embodiment, not shown in the Figures, each aperture 46 may be replaced by a pair of adjacent passageways through the post 12. One of these passageways comprises a cable passageway, preferably square or circular in shape, which is sized to receive a strengthening cable. The other such passageway is a vertically oriented slot, which is sized to receive a fish plate. These passageways are formed in the web section 36 of the post 12, preferably by stamping, and are preferably placed in the steel sheet used to form the post 12 before the sheet undergoes cold rolling to form the post 12.

Figure 7:
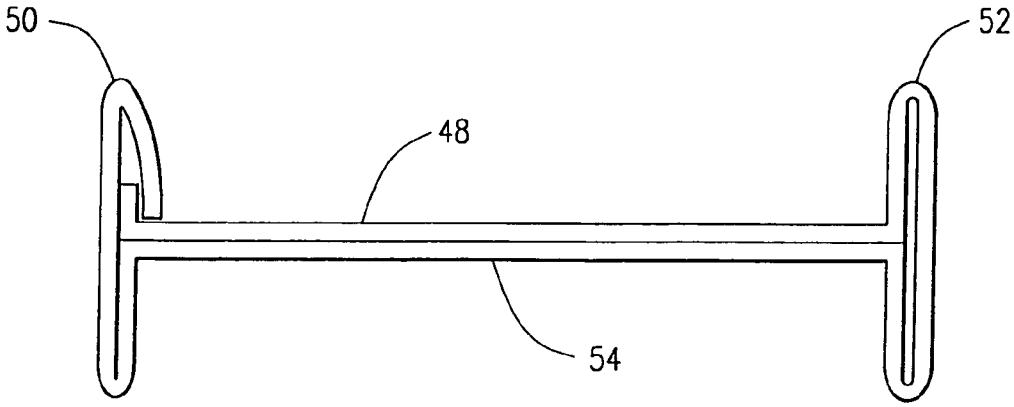
FIG. 7 is a top plan view of another embodiment of the fence post of the present invention.
Figure 5:
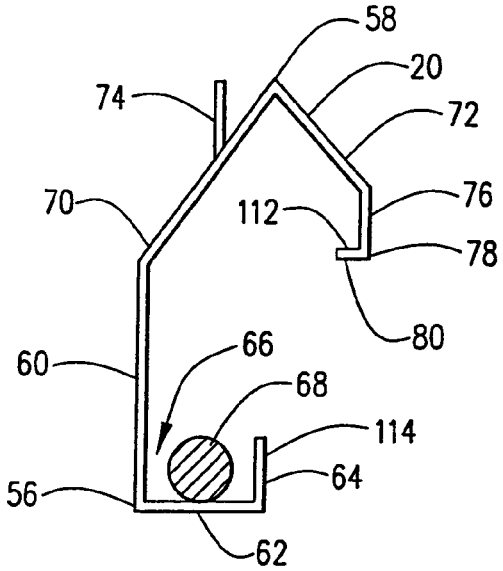
Figure 6:
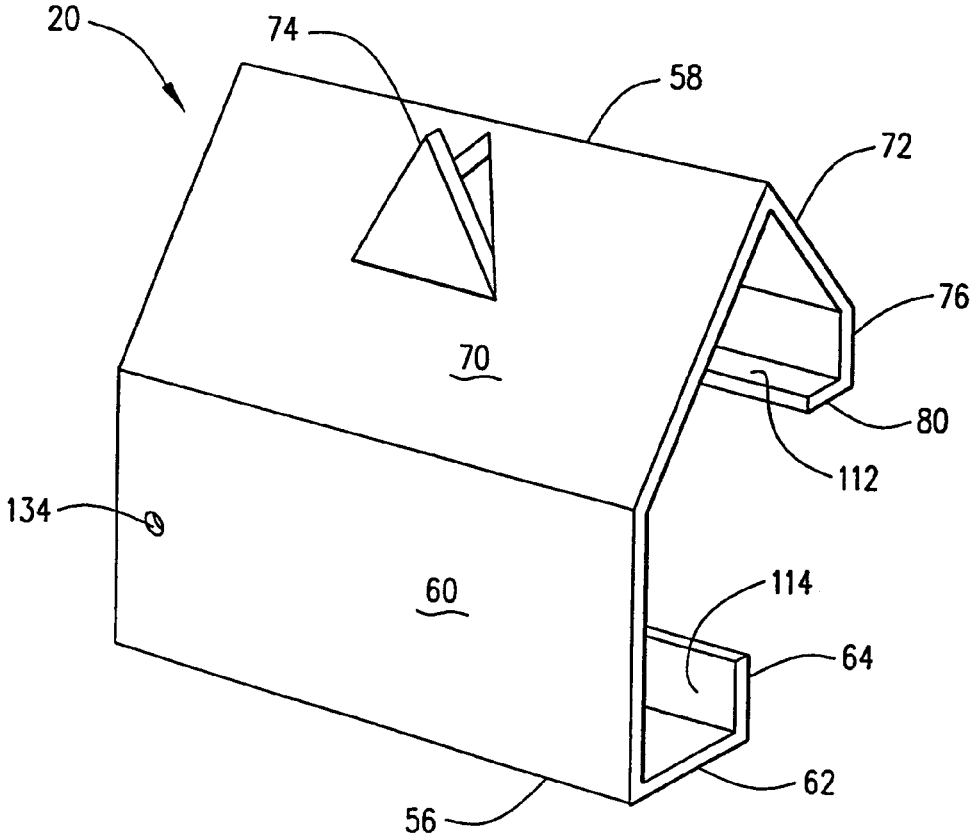

FIG. 7 shows an alternative embodiment of the post of the present invention, designated by reference numeral 48. Much like the embodiment shown in FIG. 3, the post 48 is characterized a pair of opposed flange sections 50 and 52, which are joined by flat web section 54. The flange sections 50 and 52 are each characterized by a substantially flat double-wall structure, rather than triangular cross-sectional structure of the FIG. 3 embodiment. Other features of the post 48 are identical to those described with reference to FIG. 3.

With reference to FIGS. 8 and 9, each rail 20 is preferably formed from a strong and durable material, such as a as a strip of sheet steel, which is characterized by a pair of spaced and opposed lateral edge portions 112 and 114. In a preferred embodiment of the present invention, the steel is characterized by a thickness of 0.1 inches. In order to enhance its resistance to corrosion, this steel is preferably subjected to a pre-galvanizing treatment. The pre-galvanized steel is then subjected to a cold rolling process to produce the cross-sectional shape shown in FIG. 8. After cold rolling is complete, a polyester powder coating is preferably provided in order to further enhance corrosion resistance of the rail 20.

The rail 20 is characterized by a lower section 56, which includes one of the edge portions 112, and an upper section 58, which includes the other edge portion 114. The lower section 58 comprises a flat and vertical side wall 60 which provides an attachment surface to which the pickets 24 may be secured. Further comprising the lower section 58 are horizontal base 62 and a vertical first lip 64, with the base 62 connecting the vertical lip 64 to the lower end of side wall 60. The first lip 64 includes the edge portion 114, and is disposed in spaced and parallel relationship to the side wall 60, on and the same side of the side wall 60 as edge portion 112.

The side wall 60, base 62 and vertical lip 64 cooperate to form an internal tray 66 which extends the length of the rail 20. The internal tray 66 is sized to accommodate a strengthening cable 68. Because the internal tray 66 is positioned on the back side of the fence and protected by vertical lip 64, a cable 68 within the internal tray 66 is not visible from the front, nor can it easily be accessed by a bolt cutter or similar tool.

The upper section 58 of the rail 20 preferably comprises a slanted upper front wall 70 and a slanted upper rear wall 72, which meet at their shared upper edges to define an inverted V-shaped structure. The lower edge of upper front wall 70 forms the upper edge of side wall 60. In order to deter or interfere with climbing of the fence 10, pointed spikes 74 may be formed in the upper front wall 70. Such spikes 74 may be formed by making a slit in the upper front wall 70 in the shape of an inverted V, and bending the resulting triangular tab outwardly to form a spike.

The upper section 58 of the rail 20 preferably further comprises a L-shaped upper end section 76, formed from a vertical inner wall 78 which terminates in an inwardly-projecting horizontal second lip 80, which comprises edge portion 112. The upper edge of the vertical inner wall 78 is shared with the lower edge of the upper rear wall 72. The second lip 80 extends toward the plane of side wall 60, and is preferably substantially orthogonal to the plane of side wall 60. The second lip 80 increases the strength of the rail 20.

As best shown in FIG. 2, each rail 20 is installed between an adjacent pair of posts 12 A fish plate 120 is installed within aperture 46 of each post 12, at the desired vertical position of the rail 20. The ends of the rail 20 are then connected to the fish plates 120 in the adjacent posts 12.

During installation, the rail 20 is positioned so that the fish plate 120 engages the inner side of its vertical side wall 60. The fastener openings 122 formed in the fish plate 120 are aligned with corresponding openings (not shown) formed in the vertical side walls 60. A fastener (not shown) is inserted through the pair of aligned openings and secured in place by a holder (not shown), such as a nut or collar. Each fish plate 120 can support two rails 20, one on either side of its associated post 12, and thereby functions to maintain laterally adjacent rails 20 in end-to-end alignment.

Preferably, the fastener used to secure the fish plate 120 to the rail 20 comprises a bolt, which is secured in place by a nut. More preferably, the fastener comprises a one-way bolt and a break away nut having a head configured to snap off during installation, leaving a tapered cone-type nut which is not subject to easy removal. Alternately, the fastener may comprise a rivet which is secured in place by a collar.

The cable 68 is preferably formed from a strong material such as stainless steel, and extends substantially linearly within the internal trays 66 of laterally adjacent rails 20, and through the cable passageways formed in the posts 12. Each end of the cable 68 is preferably securely anchored to an adjacent massive structure, such as a buried body of concrete (not shown). The cable 68 functions to strengthen the fence 10 against attacks by moving motor vehicles and the like.

In a preferred embodiment of the invention, the cable 68 may comprise stainless steel cable having a 0.5 inch diameter. In one embodiment, the cable 68 is positioned within a single rail 20 of the fence 10. Alternately, a plurality of strengthening cables 68 may be installed, with each 68 cable disposed within a different rail 20.

Figure 10:
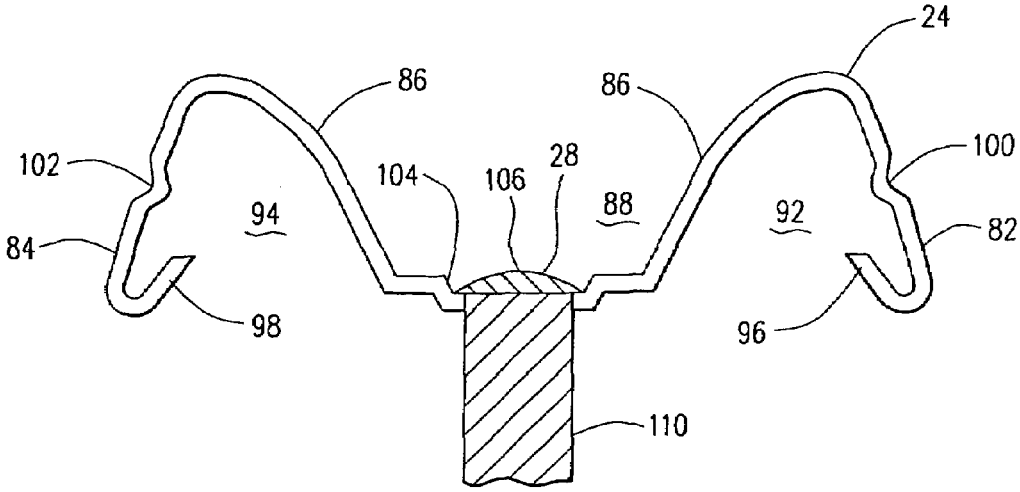
FIG. 10 is a cross-sectional view of the fence picket of the present invention, within which a fastener has been installed, taken at the position of the fastener.
Figure 11:
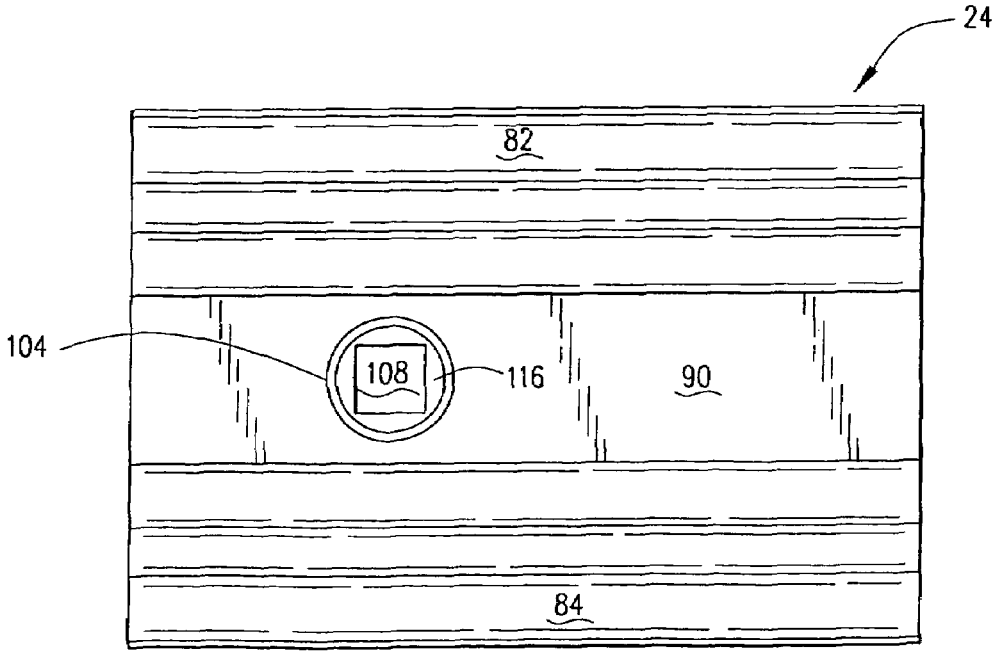
FIG. 11 is a top plan view of a portion of the fence picket of the present invention, showing a fastener recess.
Figure 12:
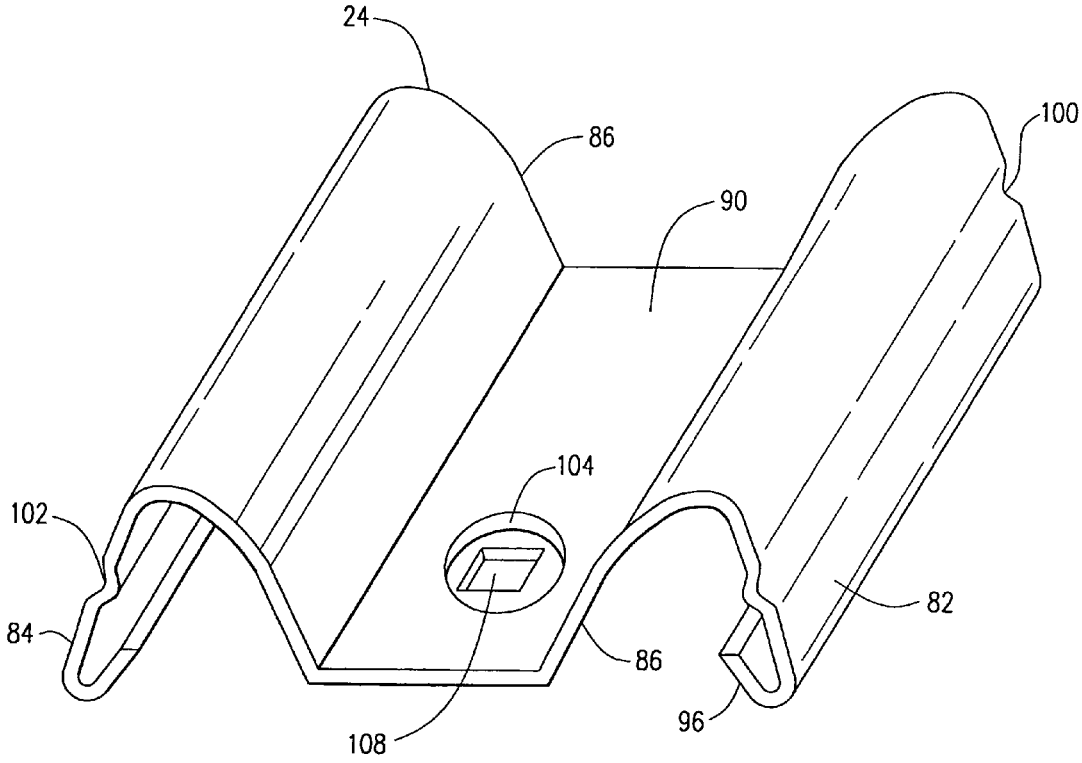
FIG. 12 is a perspective view of a portion of the fence picket of the present invention, showing a fastener recess.

With reference to FIGS. 10, 11 and 12, each picket 24 is preferably formed from a strong and durable material, such as a strip of sheet steel. In a preferred embodiment of the present invention, the steel is characterized by a thickness of 0.075 inches. In order to enhance its resistance to corrosion, this steel is preferably subjected to a pre-galvanizing treatment. The pre-galvanized steel is then subjected to a cold rolling process to produce the shape shown in FIG. 12 (aside from recess 104). After cold rolling is complete, a polyester powder coating is preferably provided in order to further enhance corrosion resistance of the picket 24.

The picket 24 is preferably characterized by a substantially W-shaped profile, which provides a corrugated structure which enhances picket strength. The picket 24 includes a pair of laterally opposed side walls 82 and 84, which are preferably inclined toward one another. Extending between the side walls 82 and 84 is a generally U-shaped medial section 86 which defines a central first channel 88. In the installed configuration of the picket 24, the first channel 88 opens in a direction away from the rails 20. The medial section 86 is preferably characterized by a substantially flat central web portion 90 which is situated at the base of the first channel 88. The web portion 90 functions as an attachment surface for engagement of the picket 24 to the vertical side wall 60 of the rail 20.

The side wall 82 and the medial section 86 further define a U-shaped second channel 92, situated on one side of the first channel 88 and extending in parallel relationship to the first channel 88. The second channel 92 is disposed in an inverted relationship to the first channel 88, opening in a direction opposed to that of the first channel 88.

The side wall 84 and the medial section 86 similarly define a U-shaped third channel 94, situated on one side of the first channel 88 and extending in parallel relationship to the first channel 88. The third channel 94 is disposed in an inverted relationship to the first channel 88, opening in a direction opposed to that of the first channel 88, and in the same direction as that of the second channel 92. As shown in FIG. 10, the second and third channels 92 and 94 are preferably each characterized by a base which is substantially rounded, although a flat base may also be provided.

With continued reference to FIGS. 10, 11 and 12, a plurality of subsurface recesses 104 which open into the first channel 88 are formed in the web 90, preferably by stamping. Each recess 104 should be sized and shaped to receive the head 106 of fastener 28 with minimal peripheral clearance, while having a depth which is less than the thickness of the web 90. If the thickness of web 90 is 0.075 inches, for example, a recess 104 having a depth of 0.065 inches may be provided. A central opening 108 is formed in the base 116 of each recess, preferably by stamping, through which the shank 110 of the fastener 28 may extend.

The head 106 of fastener 28 is not limited to any particular shape. When a circular head 106 is used for the fastener 28, for example, the recess 104 will be characterized by a matching circular cross-section which minimally clears the peripheral dimensions of the head 106. The minimal clearance between the walls of the recess 104 and the head 106, coupled with recessed position of the head 106 below the flat surface of the web 90, will hinder any effort to pry the fastener 28.

The number of recesses 104 provided in the picket 24 should equal the number of fasteners 28 which will be used to secure the picket 24 to the rails 20. In general, at least one fastener 28 should be provided for each rail 20. Likewise, the positions of the recesses 104 on the web 90 should correspond to the positions of the rails 20 in the installed configuration of the picket 24.

An inwardly turned first lip 96 projects into the second channel 92 from the lower margin of the first side wall 82. An inwardly turned second lip 98 projects into the third channel 94 from the lower margin of the second side wall 84'. As best shown in FIG. 10, the plane defined by lower margins of the side walls 82 and 84 is preferably spaced slightly below the overall plane of the central web 90, on the same level as that of the base of recesses 104.

Preferably, a first longitudinal strengthening rib 100 is formed in the first side wall 82, and a second longitudinal strengthening rib 102 is formed in the second side wall 84. As shown in FIG. 10, the rib 100 preferably comprises a depression in the outer surface of the first side wall 82 which projects inwardly into the second channel 92. The rib 102 similarly preferably comprises a depression in the outer surface of the second side wall 84 which projects inwardly into the third channel 94. In alternate embodiments, one or more strengthening ribs may be formed any one or more side walls. Ribs comprising projections from, rather than depressions in, the outer surfaces of the side walls may also be provided. The ribs are preferably characterized by a sharply angled profile which enhances the strength of the picket 24 in comparison to a more rounded rib.

The picket 24 is secured to fence by orienting the picket 24 vertically such that the flat web 90 contacts the vertical side walls 60 of the rails 20. The openings 108 formed in the recesses 104 of the picket 24 are aligned with corresponding openings 134 formed in the vertical side walls 60. A fastener 28 is inserted into the first channel 88 of the picket 24, and the shank 110 of the fastener 28 is extended through the pair of aligned openings in the web 90 and rail 20, until the head 106 is fully received within the recess 104. The fastener 28 is then secured in place by a holder (not shown), such as a nut or collar, which is installed on the reverse side of the rail 20.

Preferably, the fastener 28 comprises a bolt, which is secured in place by a nut. More preferably, the fastener 28 comprises a one-way bolt and a break away nut having a head configured to snap off during installation, leaving a tapered cone-type nut in place which is not subject to easy removal. Alternately, the fastener 28 may comprise a rivet which is secured in place by a collar.

The post 12, rails 20, and pickets 24 and associated components are well-adapted for assembly into a high security palisade fence. However, the post 12, rails 20, and pickets 24, and associated components, or any one or more of them, may also be advantageously used in other types of fence structures as well.

The fence of the present invention may be assembled from, and the methods of the invention advantageously practiced with, a kit. The kit of the present invention preferably comprises a plurality of posts, preferably identical to the posts 12. The posts 12 are preferably provided in a number sufficient to form the fence, or section thereof, to be installed.

The kit further comprises a plurality of rails, each preferably identical to the rail 20. Each such rail should be assemblable into a barrier which traverses the space between an adjacent pair of posts 20, and should have an internal tray 66 formed therein within which a strengthening cable 68 may extend. The rails 20 should be provided in the kit in a number sufficient to form the fence, or section thereof, to be installed.

The kit preferably further comprises a plurality of connectors, such as fish plate 120, for installation on the posts 12 and connection to the rails 20. The kit preferably further comprises a plurality of fasteners, for securing the ends of the rails 20 to the connectors. The connectors and fasteners should be provided in a number sufficient to permit assembly of the rails 20 required to form the fence, or section thereof, to be installed.

The kit preferably further comprises a cable 68 which is extensible within the internal tray 66 of any of the rails 20 which comprise the kit. The cable 68 for the kit may be provided in the form of an uncut elongate cable, or may be provided in the form of a plurality of precut cable segments, each of a length sufficient to form the strengthening cable required for the fence, or section thereof, to be installed. In the event that the kit includes uncut cable, that cable must be cut into cable segments of appropriate length prior to their installation into the fence or section thereof.

If the kit comprises precut cable segments, it should include such segments in a number sufficient to provide all of the strengthening cables 68 required in the fence, or section thereof, to be installed. If the kit comprises one or more uncut elongate cables, these cables should have a length sufficient to permit cutting therefrom of all of the cable segments required to form the fence, or section thereof, to be installed.

The kit preferably further comprises a plurality of pickets, preferably identical to the pickets 24, and a plurality of fasteners, for securing the pickets to the rails 20. The connectors and fasteners should be provided in a number sufficient for the fence, or section thereof, to be installed.

Changes may be made in the construction operation and arrangement of the various parts, elements, steps and procedures described herein without departing from the spirit and scope of the invention as described in the following claims.

The invention claimed is:

1. A post having opposed ends, the post adapted for incorporation into a fence which extends over a ground surface and is supported by one or more underground substrates, comprising:

a first flange section;

a second flange section having the same cross-sectional profile as the first flange section; and a flat web section disposed between the first and second flange sections, the web section formed from two abutting planar sections which define a double-walled structure, the first and second flange sections situated on opposite sides of a plane extending through a medial portion of the web section in orthogonal relationship thereto;

in which the post is adapted for installation, at one of its ends, within an underground substrate.

2. The post of claim 1 in which the sections comprise regions of a strip of material, the strip having two lateral edge portions which overlap.

3. The post of claim 2 in which the edge portions of the strip overlap in one of the flange sections.

4. The post of claim 1 in which each flange section is characterized by a flat double-walled structure.

5. The post of claim 4 in which the sections comprise regions of a strip of material, the strip having two lateral edge portions which overlap at one of the flange sections.

6. The post of claim 1 which each flange section is characterized by a triangular cross-section.

7. The post of claim 6 in which the sections comprise regions of a strip of material, the strip having two lateral edge portions which overlap at one of the flange sections.

8. The post of claim 1, in which at least one cable passageway, sized to clearingly receive a cable, is formed in the post.

9. A fence comprising a plurality of vertically disposed posts as defined in claim 1, each post embedded at one end thereof within an underground substrate, and further comprising:

a plurality of rails, with at least two rails disposed in vertically spaced relationship between each adjacent pair of posts, and with each rail supported by its opposite ends by an adjacent pair of posts; and a plurality of vertically disposed pickets, with each picket supported by at least a vertically spaced pair of rails.

10. A fence kit comprising a plurality of posts as defined in claim 1, and further comprising:

a plurality of rails; and a plurality of pickets.

11. The post of claim 2 in which the strip is characterized as continuous and having two, and only two, lateral edge portions, the lateral edge portions situated in adjacent and overlapping relationship.

12. The post of claim 11 in which the edge portions of the strip overlap in one of the flange sections.

13. The post of claim 8 in which the web section has opposed planar sides, and the cable passageway extends through the web in orthogonal relationship to the plane of the web section, so that a cable may extend from one side of the web to the other.

14. The fence of claim 9 in which the pickets are rigid.

15. The fence of claim 9 further comprising:

an extended cable adapted to strengthen the fence against impact by a moving motor vehicle.

16. The fence of claim 15, in which at least one cable passageway, sized to clearingly receive the extended cable therethrough, is formed in the web of a post, and in which the extended cable passes through that passageway.

17. The fence kit of claim 10 further comprising:

at least one cable adapted to strengthen an assembled fence against impact by a moving motor vehicle.

18. The post of claim 17, in which at least one cable passageway, sized to clearingly receive a cable, is formed in the post.

19. The post of claim 18 in which the web section has opposed planar sides, and the cable passageway extends through the web in orthogonal relationship to the plane of the web section, so that a cable may extend from one side of the web to the other.

20. A post adapted for vertical incorporation into a fence formed from a plurality of vertically spaced rails, comprising:

a first flange section;

a second flange section; and a flat web section disposed between the first and second flange sections, the web section formed from two abutting planar sections which define a double-walled structure;

in which the post has opposed upper and lower ends and is adapted, when vertical, to support a plurality of vertically spaced fence rails, such that the uppermost supported fence rail is situated at a vertical position spaced below the upper end of the post, and in which each of the flange sections is characterized by an enclosed cross-sectional profile.

21. The post of claim 20 in which the sections comprise regions of a strip of material, the strip having two lateral edge portions which overlap.

22. The post of claim 20 in which the edge portions of the strip overlap in one of the flange sections.

23. The post of claim 21 in which the strip is characterized as continuous and having two, and only two, lateral edge portions, the lateral edge portions situated in adjacent and overlapping relationship.

24. The post of claim 23 in which the edge portions of the strip overlap in one of the flange sections.

25. The post of claim 20 in which each flange section is characterized by a flat double-walled structure.

26. The post of claim 25 in which the sections comprise regions of a strip of material, the strip having two lateral edge portions which overlap at one of the flange sections.

27. The post of claim 20 which each flange section is characterized by a triangular cross-section.

28. The post of claim 27 in which the sections comprise regions of a strip of material, the strip having two lateral edge portions which overlap at one of the flange sections.

29. A fence kit comprising a plurality of posts as defined in claim 20, and further comprising:

a plurality of rails; and a plurality of pickets.

30. The fence kit of claim 29 further comprising:

at least one cable adapted to strengthen an assembled fence against impact by a moving motor vehicle.

31. A fence comprising a plurality of vertically disposed posts as defined in claim 20, and further comprising:

a plurality of rails, with at least two rails disposed in vertically spaced relationship between each adjacent pair of posts, and with each rail supported by its opposite ends by an adjacent pair of posts, with the uppermost rail supported by the post at a vertical position spaced below its upper end; and a plurality of vertically disposed pickets, with each picket supported by at least a vertically spaced pair of rails.

32. The fence of claim 31 in which the pickets are rigid.

33. The fence of claim 31 further comprising:

an extended cable adapted to strengthen the fence against impact by a moving motor vehicle.

34. The fence of claim 33, in which at least one cable passageway, sized to clearingly receive the extended cable therethrough, is formed in the web of a post, and in which the extended cable passes through that passageway.

35. A post comprising:

a first flange section;

a second flange section; and a planar web section disposed between the first and second flange sections and having opposite sides, in which the sections comprise regions of a continuous strip of material, the strip having two lateral edge portions which overlap, the web section having a cable passageway extending therethrough in orthogonal relationship to the plane of the web section, the cable passageway sized to clearingly receive a cable therethrough, so that the cable may extend from one side to the other.

36. The post of claim 35 in which the edge portions of the strip overlap in one of the flange sections.

37. The post of claim 35 in which the strip is characterized as having two, and only two, lateral edge portions, the lateral edge portions situated in adjacent and overlapping relationship.

38. The post of claim 37 in which the edge portions of the strip overlap in one of the flange sections.

39. A post comprising:

a first flange section;

a second flange section; and a planar web section disposed between the first and second flange sections and having opposite sides, the web section having a cable passageway extending therethrough in orthogonal relationship to the plane of the web section, the cable passageway sized to clearingly receive a cable therethrough, so that the cable may extend from one side to the other;

in which each flange section is characterized by a flat double-walled structure.

40. The post of claim 39 in which the sections comprise regions of a strip of material, the strip having two lateral edge portions which overlap at one of the flange sections.

41. A post comprising:

a first flange section;

a second flange section; and a planar web section disposed between the first and second flange sections and having opposite sides, in which the web section is formed from two abutting planar sections which define a double-walled structure, the web section having a cable passageway extending therethrough in orthogonal relationship to the plane of the web section, the cable passageway sized to clearingly receive a cable therethrough, so that the cable may extend from one side to the other.

42. A post comprising:

a first flange section;

a second flange section; and a planar web section disposed between the first and second flange sections and having opposite sides, the web section having a cable passageway extending therethrough in orthogonal relationship to the plane of the web section, the cable passageway sized to clearingly receive a cable therethrough, so that the cable may extend from one side to the other;

in which each flange section is characterized by a triangular cross-section.

43. The post of claim 42 in which the sections comprise regions of a strip of material, the strip having two lateral edge portions which overlap at one of the flange sections.

44. A fence comprising:

a plurality of vertically disposed posts, each post comprising:

a first flange section;

a second flange section; and a planar web section disposed between the first and second flange sections and having opposite sides, the web section having a cable passageway extending therethrough in orthogonal relationship to the plane of the web section, the cable passageway sized to clearingly receive a cable therethrough, so that the cable may extend from one side to the other;

a plurality of rails, with at least two rails disposed in vertically spaced relationship between each adjacent pair of posts, and with each rail supported by its opposite ends by an adjacent pair of posts;

a plurality of vertically disposed pickets, with each picket supported by at least a vertically spaced pair of rails; and at least one cable adapted to strengthen an assembled fence against impact by a moving motor vehicle, the cable extending through the cable passageway of at least one post.

45. The fence of claim 44 in which the cable is characterized as extending through the cable passageways of a plurality of posts.

46. A post comprising:

a first flange section;

a second flange section; and a planar web section the web section disposed between the first and second flange sections;

in which the flange and web sections comprise regions of a continuous strip of material, the strip having two, and only two, lateral edge portions, the lateral edge portions situated in adjacent and overlapping relationship.

47. The post of claim 46 in which the edge portions of the strip overlap in one of the flange sections.

48. The post of claim 47 in which the web section is formed from two abutting planar sections which define a double-walled structure.

49. The post of claim 46 in which each flange section is characterized by a flat double-walled structure.

50. The post of claim 49 in which the edge portions of the strip overlap in one of the flange sections.

51. The post of claim 46 which each flange section is characterized by a triangular cross-section.

52. The post of claim 51 in which the edge portions of the strip overlap in one of the flange sections.

53. The post of claim 46, in which at least one cable passageway, sized to clearingly receive a cable, is formed in the post.

54. The post of claim 53 in which the web section has opposed planar sides, and the cable passageway extends through the web in orthogonal relationship to the plane of the web section, so that a cable may extend from one side of the web to the other.

55. The post of claim 46 in which the post is characterized as having opposed ends, and in which the post is adapted for incorporation into a fence which extends over a ground surface and is supported by one or more underground substrates, and in which the post is adapted for installation, at one of its ends, within an underground substrate.

56. The post of claim 46 in which the post has upper and lower ends and is adapted for vertical incorporation into a fence formed from a plurality of vertically spaced rails, such that the vertical post may support a plurality of vertically spaced fence rails, with the uppermost supported fence rail is situated at a vertical position spaced below the upper end of the post.

57. A fence comprising a plurality of vertically disposed posts as defined in claim 46, and further comprising:

a plurality of rails, with at least two rails disposed in vertically spaced relationship between each adjacent pair of posts, and with each rail supported by its opposite ends by an adjacent pair of posts; and a plurality of vertically disposed pickets, with each picket supported by at least a vertically spaced pair of rails.

58. The fence of claim 57 in which the plural pickets are rigid.

59. The fence of claim 57 further comprising:

an extended cable adapted to strengthen the fence against impacts by moving motor vehicles.

60. The fence of claim 59, in which at least one cable passageway, sized to clearingly receive the extended cable therethrough, is formed in the web of a post, and in which the extended cable passes through that passageway.

61. The fence of claim 60 in which the cable is characterized as extending through the cable passageways of a plurality of posts.

62. A fence kit comprising a plurality of posts as defined in claim 46, and further comprising:

a plurality of rails; and a plurality of pickets.

63. The fence kit of claim 62 further comprising:

at least one cable adapted to strengthen an assembled fence against impact by a moving motor vehicle.

64. A post comprising:

a first flange section;

a second flange section; and a planar web section disposed between the first and second flange sections and having opposite sides, the web section having a cable passageway extending therethrough in orthogonal relationship to the plane of the web section, the cable passageway sized to clearingly receive a cable therethrough, so that the cable may extend from one side to the other;

in which the post has upper and lower ends and is adapted for vertical incorporation into a fence formed from a plurality of vertically spaced rails, such that the vertical post may support a plurality of vertically spaced fence rails, with the uppermost supported fence rail is situated at a vertical position spaced below the upper end of the post.

65. A fence kit comprising:

a plurality of posts, each post comprising:

a first flange section;

a second flange section; and a planar web section disposed between the first and second flange sections and having opposite sides, the web section having a cable passageway extending therethrough in orthogonal relationship to the plane of the web section, the cable passageway sized to clearingly receive a cable therethrough, so that the cable may extend from one side to the other;

a plurality of rails;

a plurality of pickets; and at least one cable adapted to strengthen an assembled fence against impact by a moving motor vehicle.

* * * * *